United States Patent [19]

Basse et al.

[11] 4,303,346

[45] Dec. 1, 1981

[54] PRINTER HEAD CLUTCH

[75] Inventors: William J. Basse, Plymouth; James M. Baker, Clinton, both of Mich.

[73] Assignee: Sycor, Inc., Ann Arbor, Mich.

[21] Appl. No.: 38,683

[22] Filed: May 14, 1979

[51] Int. Cl.[3] ..... B41J 29/50

[52] U.S. Cl. ..... 400/342; 400/351; 400/616.1

[58] Field of Search ..... 400/291, 292, 320, 337, 400/340, 341, 342, 345, 351, 350, 616.1; 188/67; 74/531

[56] References Cited

U.S. PATENT DOCUMENTS

| | | | |
|---|---|---|---|
| 3,426,880 | 2/1969 | Blodgett | 400/124 |
| 3,572,487 | 3/1971 | Rolph et al. | 400/342 X |

FOREIGN PATENT DOCUMENTS

| | | | |
|---|---|---|---|
| 515767 | 8/1955 | Canada | 188/67 |
| 2110423 | 9/1972 | Fed. Rep. of Germany | 400/320 |
| 1248805 | 10/1971 | United Kingdom | 400/340 |

OTHER PUBLICATIONS

IBM Tech. Disc. Bulletin, "Strain Relief Device," by E. Uberbacher, vol. 4, No. 8, Jan. 1962, p. 8.

*Primary Examiner*—Paul T. Sewell

*Attorney, Agent, or Firm*—Price, Heneveld, Huizenga & Cooper

[57] ABSTRACT

A clutch for stopping lateral motion of a first element or device, such as a print head in a data printer, which moves along an elongated second member such as a rod or bar. The clutch includes a movable clutch member with an aperture through which the elongated bar passes. In a data printer, this bar may be the guide bar along which the print head moves laterally. The print head or other such first member is coupled to the clutch member to move it along the bar so long as the clutch member is aligned generally normal to the bar, in which condition the bar passes freely through the aperture in the clutch member. An actuator aligned with the clutch member along its lateral travel path is put into position at a point along such travel path where it is desired to stop the moving print head or other device, and operates to tilt the clutch member so that it cocks into engagement with the bar. This produces a binding action which prevents any further movement of either the clutch member or the primary device (e.g., print head). A spring interposed between the primary device and the clutch member helps to ensure that the clutch does not actuate other than by the operation of the actuator member; also, such spring helps to release the clutch to permit desired movement of the clutch and primary device.

16 Claims, 6 Drawing Figures

PRINTER HEAD CLUTCH

BACKGROUND OF THE INVENTION (1) Field of the Invention

This invention relates generally to printing apparatus and to apparatus for controlling the movement of a printing head; more particularly, the invention relates to a novel clutch or braking mechanism, and to use of the same in a data printer.

(2) Prior Art

In prior printers the limits of lateral print head movement were usually defined by setting left and right margin stops at the desired positions. Typically, such margin stops are mechanical elements which extend outward from the frame or other rigid portion of the data printer into the lateral travel path of the print head, and which are sufficiently rigid to withstand the entire force applied by a laterally moving print head, thereby stopping the print head by physically blocking it. When a print head is being laterally driven, the force needed to stop the print head in this manner can often be in the range of 50 to 60 pounds. Clearly, designing and constructing adjustable margin stops to withstand such magnitudes of force very materially increases the cost of the printer. Further, operator error in setting the margin stops may permit the print head to move off the printing surface and result in damage to the print head. Attempts at using various electronic control means to control the lateral travel of the print head add complexity and increase expense of fabrication of a data printer, and these are relatively susceptible to operator error and malfunction.

The damage to the print head can be particularly severe when the printing surface is relatively thick (e.g., multi-layered) and the print head is a wire matrix type. Although printing off the edge of the printing surface onto the platen may cause some damage, a more serious problem arises when returning the print head onto the printing surface to print the next line. For example, after the print head has been permitted to print beyond the edge of the printing surface, moving the print head from a position off the printing surface to a position on the printing surface with the needles extended can bend the needles, thereby destroying the head. This can happen either during initial set-up of the machine or when there are incorrect margin settings. These are some of the problems this invention overcomes.

SUMMARY OF THE INVENTION

A clutch means for stopping lateral motion of a movable member, such as a print head in a data printer, is coupled to and movable with the member. The structure supporting the print head, or other such member, has a fixed guide element associated therewith that is selectively engageable by a part of the clutch, which part is selectively positionable between an engaging position, wherein it engages the guide element and generates a stopping force for stopping the movable member, and a travel position, wherein the clutch part moves freely with respect to the guide element, thus permitting free movement of the clutch. An important aspect of this arrangement is that the force required to stop the movable member is at least partially generated at, and to some extent in, the clutch, and applied to the print head.

In accordance with one embodiment of this invention, the primary operating member of the clutch means includes an apertured element in the general nature of a washer which cocks into wedging engagement with a slider bar whose primary function is to guide the print head along a lateral path, thus utilizing positive frictional wedging forces as the braking force. Advantageously, in one embodiment of this invention, the means for selecting between the engaging position and the travel position for the clutch means is an actuator arm coupled to a tractor-type printing media drive. Thus the actuator arm is automatically positioned at the edge of the form or document to be printed when the tractor drive is positioned to receive the form. As a result, a relatively simple mechanical apparatus is available for controlling lateral movement of the print head, and the actuator arm need not be built to sustain the entire force of the laterally moving print head. Further, an embodiment of this invention can include a spring means coupled between the print head and the clutch means for exerting a force tending to position the clutch means in the travel position. This is advantageous for ensuring that the clutch actuates only when desired, and that at all other times the clutch rides smoothly along the guide bar.

DETAILED DESCRIPTION OF THE INVENTION

Figure 1:
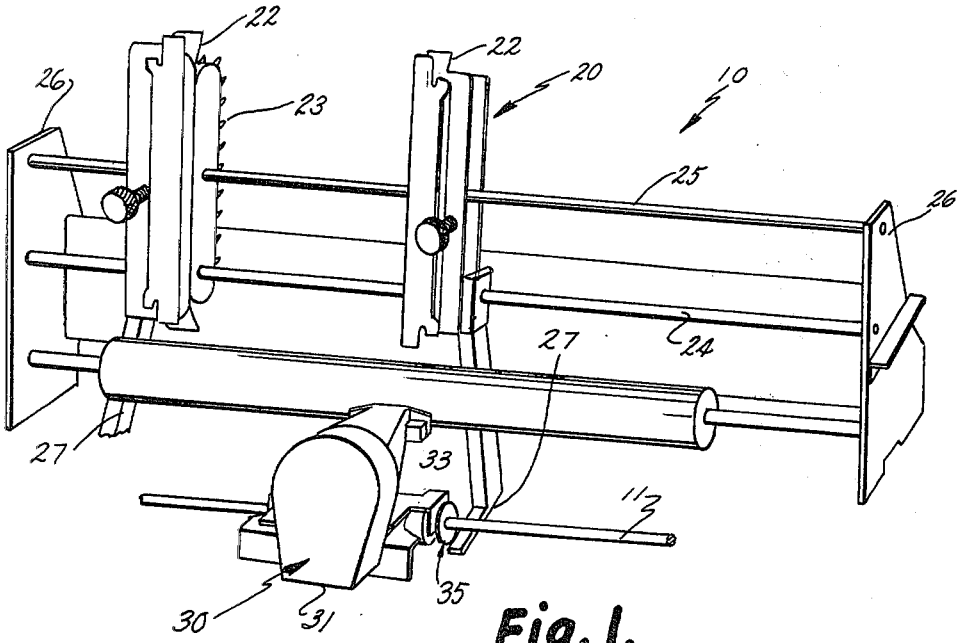
FIG. 1 is a fragmentary front perspective view of portions of a printer assembly including a tractor-type paper feeding apparatus and a print head assembly incorporating travel control apparatus in accordance with an embodiment of this invention.

Referring to FIG. 1, an illustrative printer assembly 10 includes a tractor-type paper feed module 20, for supporting and driving a printing media such as preprinted forms or the like having continuous drive apertures along each side. A print head asembly 30 is laterally movable along a slider bar 11, for imprinting characters on the printing media. Print head assembly 30 includes a print head 31 which is coupled to slider bar 11 by a clutch element 35, or brake, which can be placed in an engaging position to stop movement of print head assembly 30 along slider bar 11, or placed in a travelling position permitting free movement of print head assembly 30 along slider bar 11. The means for making such positioning changes of the element 35 to enable travelling positions and engaging positions is an actuator arm 27 coupled to a portion of tractor module 20.

Tractor module 20 includes a pair of generally planar, parallel spaced end plates 26 (FIG. 1) between which are mounted, with parallel axes, a platen 21 (shown as a typical roller device), an elongated tractor support bar 24, and an elongated tractor drive bar 25. Platen 21 is rotatable and has an elongated cylindrical shape for supporting the printing media during printing on its surface. As will be understood, the printing media typically has a continuous sequence of regularly-spaced holes along its edges for engaging the pins on the drive chain of a typical tractor-type drive member. A pair of tractor supports 22 are slidably mounted on tractor support bar 24 and tractor drive bar 25, with such bars extending through transverse apertures provided for this purpose. Each of the tractor supports 22 has a movable tractor drive chain 23 extending continuously around the drive and support bars 24 and 25, in a plane normal to such bars. Tractor drive chain 23 has links with protruding pins for engaging the holes along the edges of the printing media, as is conventionally true. Tractor drive bar 25 has longitudinal splines and extends through an internally-splined drive gear in each of tractor supports 22 to move the tractor drive chains 23 when the drive bar 25 is rotated. Accordingly, tractor drive bar 25 may be driven by any desired rotary device, such as an electric motor, for example a step motor which will rotate the bar a desired, angular displacement which will in turn move the tractor drive chains and the print media a predetermined extent.

To position a printing media on tractor module 20, tractor supports 22 are laterally moved to the correct width spacing so that the holes along the edges of the printing media can engage the pins carried on the tractor drive chains 23. Rotating the tractor drive bar 25 then causes the chains 23, which are in the form of loops, to move lengthwise. This applies a tension pulling force to the printing media, pulling it around platen 21 and upward relative to the platen, thereby effecting line advancement of the print media.

Print head assembly 30 is shown for purposes of illustration, a print head 31 which is of the dot matrix type, having a column of needles facing the printing media, for imprinting dots on the printing surface so as to form characters by coherent groupings of dots. In a larger sense, however, the head used is not particularly importaant to the invention; that is, the motion-controlling clutch or brake apparatus is usable with other types of print head, or for that matter, other types of device whose motion or position is to be controlled.

Figure 2:
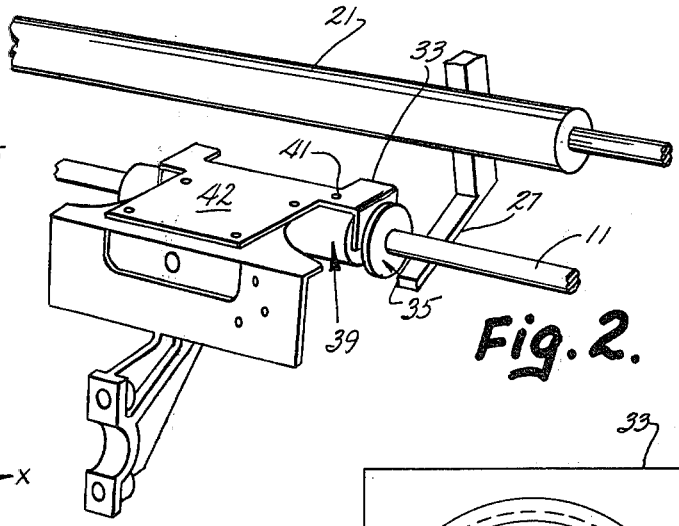
FIG. 2 is an enlarged view of a fragmentary portion of FIG. 1 showing portions of the clutch apparatus coupled to a print head support, and an actuator for the clutch, in accordance with the embodiment of FIG. 1.
Figure 5:
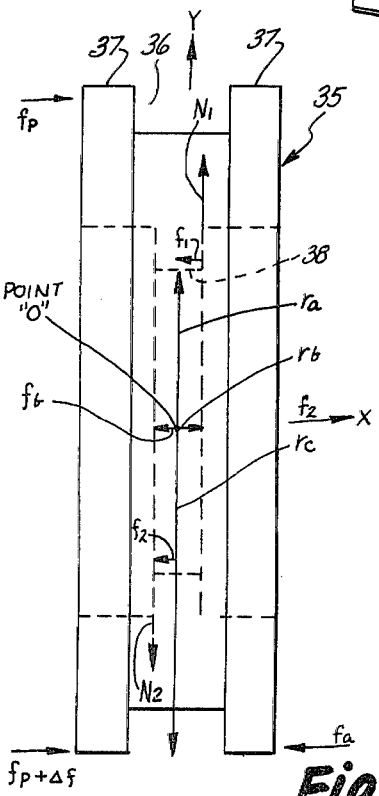
FIG. 5 is a side elevation view of a clutch element in accordance with the particular embodiment of the invention referred to above, and includes a schematic representation of forces acting on the clutch element in an engaging position.
Figure 6:
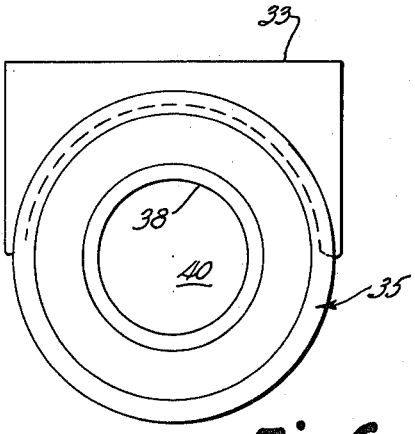
FIG. 6 is an end elevational view of the clutch element shown in FIG. 5 and including a partial end view of a supporting bracket coupled between the washer and the print head.
Figure 3:
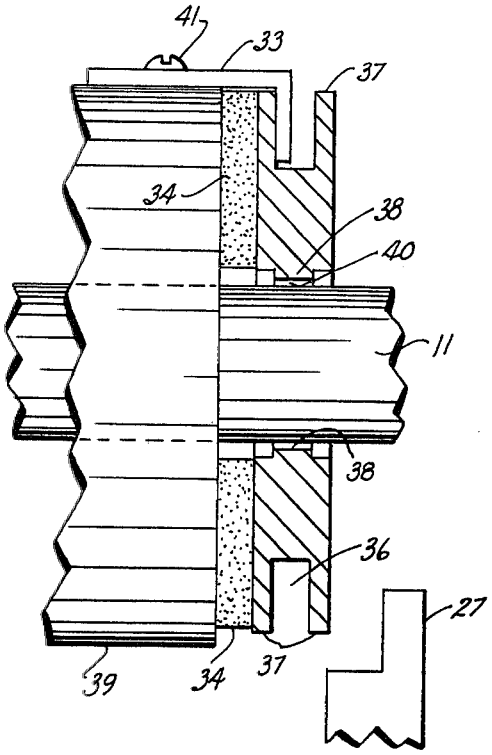
FIG. 3 is a partial sectional view of a clutch in accordance with the embodiment of the preceding Figures, shown coupled to a print head in a travel position and spaced from an actuator for the clutch.
Figure 4:
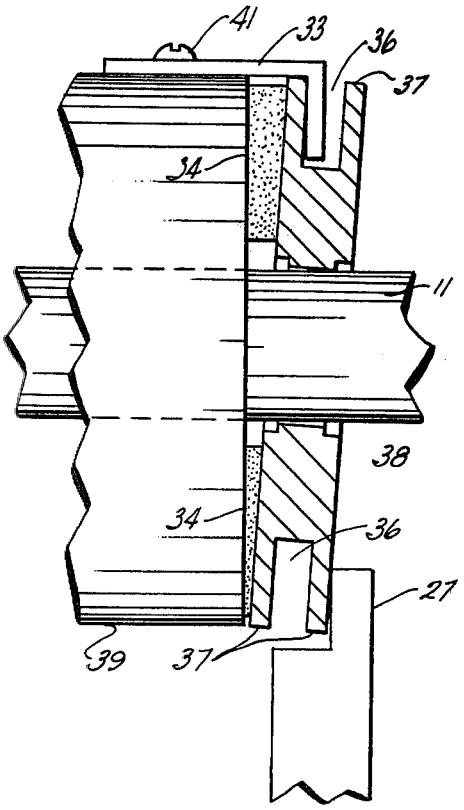
FIG. 4 is a partial sectional view similar to FIG. 3 but showing the actuator in contact with the clutch and the clutch in an engaging position.

An actuator arm 27 extends downwardly from the back of each tractor support 22, under platen 21 and toward print head assembly 30. Advantageously, the actuator arms 27 are laterally spaced from the edge of the printing media sufficiently that the printing needle elements of print head 31 can reach the extreme edge of the paper, but not beyond this point, before the actuator arms position the clutch element 35 so that it stops lateral movement of print head assembly 30. A slidable carriage 39 (FIG. 2) provides a preferred mounting means for print head 31, and serves to couple print head 31 to slider bar 11. Carriage slider 39 includes an elongated opening sized to pass over slider bar 11, and includes a mounting plate 42 for receiving print head 31 to couple it to the carriage slider 39. Print head 31 and carriage slider 39 are typically moved laterally back and forth by such means as a worm-gear or a lead screw drive (not shown). As shown in FIGS. 2–4, the clutch element 35 is movably carried by carriage slider 39, being coupled thereto by a bracket 33. Referring to FIGS. 2–6, clutch element 35 is generally disc-shaped in the preferred embodiment under discussion, with a central opening 40 for passing slider bar 11 therethrough. Central opening 40 is somewhat larger in diameter than the diameter of slider bar 11, so that element 35 can tilt away from a position perpendicular to the longitudinal axis of slider bar 11 to a position angular with respect thereto, thus binding against slider bar 11. The clutch element 35, which in the particular embodiment here disclosed comprises a washer-like member, includes a centrally-located circumferential groove 36 around its periphery (FIG. 5). Groove 36 is bounded by outwardly-protruding rims 37 on each side, which extend around the circumference of the washer-like member 35. A generally annular flange 38 (FIGS. 3 and 4) extends radially inwardly, into the central opening 40. The thickness of flange 38 is somewhat less than the total thickness or width of clutch member 35 and this relative dimension, with that of the internal diameter of the flange, determines the amount of allowable tilt which member 35 may take with respect to slider bar 11 in order to cause engagement of slider bar 11 by member 35. The ratio of the force applied by actuator arm 27 on member 35 to the magnified force applied by member 35 on print head assembly 30 is proportional to the ratio of the diameter of member 35 to the width of flange 38. For example, in a typical installation, member 35 applies a force of about 60 pounds and actuator arm 27 applies a force of about 10 pounds.

A generally L-shaped angular bracket portion 33 (FIGS. 2–4) on or secured to mounting plate 42 couples the clutch element 35 to the carriage slider 39 such that a first part of bracket 33 extends generally parallel to the longitudinal axis of slider bar 11 and an offset perpendicular part at the extremity of such parallel portion extends toward the longitudinal axis of slider bar 11. This extending part has a generally semi-circular recess for fitting around the circumference of approximately half of the groove 36 in element 35 (see FIG. 6). Thus, the generally vertical portion of bracket 33 is somewhat fork-like in nature, and serves to orient and position the clutch element 35.

Positioned on slider bar 11 between carriage slider 39 and clutch 35 is a resilient biasing member 34 which may be a generally annularly-shaped piece of resilient material such as an elastomeric foam or the like having about the same diameter as clutch element 35. The thickness of biasing element 34 and the spacing of the vertical portion of bracket 33 from carriage slider 39 are such that when clutch element 35 is positioned with its groove 36 in registry with the depending fork bracket 33, biasing element 34 is somewhat under compression and tends to push the clutch element outwardly and away from carriage slider 39, thereby positioning the major plane of clutch element 35 generally perpendicular to the longitudinal axis of slider bar 11. The end of carriage slider 39 adjacent clutch member 35 has a generally planar surface which is perpendicular to the longitudinal axis of slider bar 11.

In order to maintain the resilient element, or spring, 34 in the proper relative position between clutch element 35 and carriage slider 39, biasing element 34 may advantageously be bonded to one or both of the clutch element 35 and/or carriage slider 39. For example, the resilient element 34 can be molded upon the side of, or glued to, element 35. A function of spring 34 is to apply a force to clutch element 35 which tends to return the latter from an engaging position to a travelling position. However, the force applied by spring 34 must be less than the force applied by actuator arm 27, so that clutch element 35 can be initially tilted by the actuator arm to an engaging position. After clutch element 35 engages slider bar 11, the binding or wedging action between element 35 and slide bar 11 is essentially self-energizing, and additional force need not be applied by actuator arm 27. When print head assembly 30 begins to move away from actuator arm 27, the wedging force is reversed, and thereby released, whereupon spring 34 may act to tilt element 35 back to a normal, i.e., non-engaging, position. Indeed, it is advantageous that spring 34 extend around a substantial portion of the circumference of clutch element 35 rather than act at only a single location or a small semi-circular arc, so that the transition from the engaging position to the travelling position is more readily accomplished.

Referring to FIG. 5, a side elevational view of clutch element 35 is shown with an indication of the forces acting on it as if it were in the engaging position shown in FIG. 4, with the carriage pushing to the right. A Y-axis is defined as extending positively upward and an X-axis is defined as acting positively to the right. At the top left of element 35, acting in a positive "X" direction, is a pre-load force, Fp, due to compression of spring 34. At the bottom left of element 35, acting in a positive "X" direction, is Fp+ΔF, the preload force plus an incremental force due to further compression of spring 34 caused by tilting of clutch element 35. A force $F_B$ is the force of bracket 36 acting on clutch 35, and considered to be acting at the center of the latter in a negative X-direction. A force $F_A$ acts in a negative X-direction at the bottom right of clutch 35 and is due to the action of actuator arm 27 on the clutch element. Forces $N_1$ and $N_2$ are normal forces applied by slider bar 11 to clutch 35 at the right and left sides, respectively, of flange 38 in positive Y and negative Y-directions, respectively. Forces $f_1$ and $f_2$ are associated with forces $N_1$ and $N_2$, respectively, being the frictional forces stopping the carriage which are produced by the normal forces due to the tilting or cocking of clutch 35, and are in negative X and positive X-directions, respectively. The designations $r_a$, $r_b$ and $r_c$ are distances which represent, respectively, the radius of central opening 40 to flange 38, half the width of flange 38, and the radius of clutch 35. Using the above forces, the magnification of $F_A$, the force applied by actuator arm 27, can be derived:

First, summing forces in the X-direction, which must equal zero when clutch 35 is stopped:

$$\Sigma F_x = o = F_p + F_p + \Delta F - F_B - f_1 - f_1 - F_A$$

Second, summing forces in the Y-direction, which must equal zero when clutch 35 is stopped:

$$\Sigma F_y = o = N_1 - N_2 \text{ or } N_1 = N_2$$

Third, summing moments about the center point, with a clockwise moment being defined as negative, the sum of which must equal zero when clutch 35 is stopped:

$$\Sigma M_o = o = -r_c(F_p) + r_c(\text{is } F_p\Delta F) - r_c F_A + r_a f_1 - r_a f_2 + r_b N_1 + r_b N_2 + o(F_B)$$

where M is the total moment.

If $\mu$ is the coefficient of friction between clutch 35 and slider bar 11, then:

$$f_1 = \mu N_1 \text{ and } f_2 = \mu N_2$$

Therefore, if $N_1 = N_2$, $\mu N_1 = \mu N_2$, and $f_1 = f_2$ $$\Sigma M_o = o = r_c \Delta F - r_c F_A + 2 r_b N_1$$

$$r_c(F_A - \Delta F) = 2 r_b N_1$$

$$N_1 = (r_c/r_b)(F_A - \Delta F)/(2)$$

where $(F_A - \Delta F)/2$ is the net force acting to cock the clutch and $r_c/r_b$ is the force magnifier.

In an example in accordance with one embodiment of this invention, the opening bounded by flange 38 has a diameter of approximately 0.002 to 0.005 inches larger than the diameter of slider bar 11 which can be, for example, ½ inch. Typical dimensions for clutch 35 include a diameter of 1.5 inches, a total width of 0.31 inches, a width for rim 37 of 0.08 inches, a diameter of central opening 40 of about 0.62 inches, and a height of flange 38 extending into central opening 40 of about 0.034 inches. A typical material for clutch 35 is steel, and a typical material for carriage slider 39 is a cast metal. Clutch 35 is advantageously made of a material softer than slider bar 11 to avoid damaging slider bar 11 when clutch 35 tilts and wedges against the bar. Actuator arm 27 is typically made of a material such as aluminum, and has a generally hook-like shape. Thus, arm 27 can extend down from tractor supports 22, around platen 21 and into the lateral path of clutch 35. A typical material for spring 34 is urethane foam, having a durometer in the range of about 60 to about 90 (Shore A), and having a thickness of about ¼ inch.

OPERATION

With print head 31 mounted upon carriage slider 39 and the latter at rest, spring 34 is partially compressed uniformly over its entire area so that it maintains clutch element 35 generally perpendicular to the longitudinal axis of slider bar 11. The internal diametral flange 38 of the clutch element is thus disposed parallel to the surface of slider bar 11 or resting lightly on it, so that the clutch element can freely slide along slider bar 11. As carriage 39 and print head assembly 30 then move along slider bar 11 toward actuator arm 27, the leading edge of clutch 35 contacts actuator arm 27 and, as the print head moves further in the same direction, the actuator arm tilts clutch 35 with respect to the longitudinal axis of slider bar 11 (FIG. 4). As clutch 35 tilts, the trailing edge of the portion of flange 38 nearest actuator arm 27 slidingly engages slider bar 11, and the leading edge of the portion of flange 38 furthest from actuator arm 27 engages slider bar 11 with a wedging, binding angular shoulder engagement. This binding or wedging action between flange 38 and slider bar 11 precludes clutch or wedging 35 from any further motion along slider bar 11, which in turn prevents any further motion of carriage slider 39 and print head 30 in the direction toward actuator arm 27.

As already noted above, the force needed to be applied by actuator arm 27 in braking the carriage and print head is only the amount required to overcome spring 34 and tilt clutch 35. Once clutch 35 is tilted and engages slider bar 11, the clutch element itself provides the force to stop print head assembly 30, since the clutch element wedges into fixed position along the slider bar. Thus, actuator arm 27 and tractor supports 22 which carry actuator arm 27 need not be specifically reinforced to withstand the full force of braking print head movement. This is particularly advantageous because actuator arm 27 is the laterally movable (position adjustable) member which determines the point at which print head assembly 30 will be stopped. The described embodiment is particularly advantageous because actuator arm 27 is automatically positioned at the edge of the printing surface as a result of setting the paper feed apparatus (i.e., the tractors and their supports) to accommodate the particular width of paper or the forms being used. Thus, once the printing media is inserted into printer assembly 10, the left and right allowable margin extremes are automatically established. That is, although the above discussion has been focused on stopping movement to the right of printer assembly 10, it should be appreciated that a completely analogous system can be used to stop leftward movement of print head assembly 30.

Various modifications and variations of the subject matter specifically shown and discussed may, following consideration hereof, occur to those skilled in the art to which this invention pertains. For example, the particular spring means or details of actuator arm mechanism may be varied from that disclosed herein. Similarly, the connection between the clutch element and the print head may be varied from that disclosed herein, as may details of the clutch element itself.

Further, it should be noted that the actuator arm mechanism may, within the broader aspects of the invention be implemented in numerous other ways, including the use of remotely positionable or moving members and/or by remotely controllable or actuable elements. For example, a solenoid-actuated member may be carried on the print head with the clutch element, so that clutch actuation could be a programmable function. In such an instance, clutch element release must be effected by countervailing measures, or else the print head (or other primary member) must be moved in the opposite direction after being so stopped, to allow the clutch element to disengage from the guide bar. These and all other variations which basically rely on the teachings through which this disclosure has advanced the art are properly considered within the scope of this invention.

The emboodiments of the invention in which an exclusive property or privilege is claimed are defined as follows:

1. A clutch means for stopping lateral motion of a movable print head in a data printer, said printer having an elongated shaft element along which the print head is laterally movable during printing operation, comprising: a clutch member, and means for coupling said clutch member to the print head for lateral movement therewith; said clutch member being selectively positionable between an engaging position wherein said clutch member engages said elongated shaft and generates a stopping force for stopping said print head, and a travel position wherein said clutch member moves freely along said elongated shaft permitting free movement of said print head; and an actuating means for positioning said clutch member in its said engaging position, said actuating means being movable to selected positions along the length of said elongated shaft independently with respect to the print head so as to selectively define the extent of lateral print head motion.

2. A clutch means as recited in claim 1 wherein said clutch member includes a disc-like member having an aperture for receiving said shaft element, said disc-like member freely passing along said shaft element when the plane of said member is substantially perpendicular to the longitudinal axis of said shaft element, and said disc-like member engaging said elongated shaft when the plane of said disc-like member is sufficiently tilted with respect to a plane normal to the longitudinal axis of said shaft.

3. A clutch means as recited in claim 2 wherein said clutch means includes a resilient biasing means between said disc-like member and said print head for applying a force to said disc-like member tending to maintain the plane of said member generally perpendicular to the longitudinal axis of said elongated shaft member.

4. A clutch means as recited in claim 3 wherein said resilient biasing means comprises a compressible element positioned adjacent a first side of said disc-like member.

5. A clutch means as recited in claim 2 wherein said actuating means includes an arm extending into the lateral travel path of said disc-like member.

6. A clutch means as recited in claim 5 wherein the data printer includes a tractor-type print media advancement means, said arm being coupled to said tractor means and being laterally movable therewith to a plurality of stop positions, each of said stop positions being in the lateral travel path of said disc-like clutch member.

7. A clutch means as recited in claim 6 further comprising a connection means between said disc-like member and the print head for moving said disc-like member along said elongated shaft while maintaining the plane of said disc-like member substantially perpendicular to the longitudinal axis of said shaft.

8. A clutch means as recited in claim 7 wherein said connection means includes a recess disposed at the periphery of said disc-like member and a bracket coupled to the print head and extending radially into said recess.

9. A clutch means as recited in claim 5 including a pair of said disc-like members, one of said pair being positioned on each side of the print head; and a pair of said actuating arms, one at each side of the print head, each such arm providing a means for stopping movement of the print head in one of two lateral, opposite directions.

10. In a data printer of the general type having a printer head for printing characters along a horizontal print line on a printing surface, and a printing surface drive and guide means for guiding and moving the printing surface in at least one direction relative to the printer head, the improvement comprising: clutch means for limiting movement of said printer head along said horizontal print line; laterally movable actuator means for positioning at any of a plurality of locations to thereby define a lateral boundary of a print field on the printing surface; said clutch means including means for stopping relative lateral movement between said printer head and said printing surface in said one direction; said stopping means and said actuator means arranged to act in cooperation such that said actuator means actuates said stopping means to stop relative movement between said printer surface and said printer head at the lateral boundary set by the positioning of said actuator means at said locations; said actuator means comprising an element extending outward from a portion of said printing surface drive and guide means adjacent the side edge of the printing surface and extending into alignment with said stopping means.

11. The improvement as recited in claim 10 wherein said printer head rides along a support means including an elongated rod, and said stopping means comprises a member which is movable along and guided by said elongated rod.

12. The improvement as recited in claim 11 wherein said stop means is coupled to said printer head and moves with the latter along said elongated rod.

13. The improvement as recited in claim 12 wherein said stop means has a first condition wherein it is movable freely along said support means, and also has a second condition wherein it engages said support means in a manner stopping movement of said printer head relative to said support means.

14. The improvement as recited in claim 13 wherein said stopping means comprises a washer-like member having a generally centrally-disposed aperture through which said elongated rod extends, said washer-like member being movable along said rod when positioned generally perpendicular to the longitudinal axis of said rod and being frictionally engageable with said rod at the aperture of the washer-like member when the latter is disposed in a plane which forms an acute angle with respect to the longitudinal axis of said rod.

15. The improvement as recited in claim 14 wherein the ratio of the net force applied by said actuator means to said washer-like member with respect to the force applied by said washer-like member to stop the printer head is proportional to the ratio of the width of said washer-like member at the innermost peripheral boundary of said central aperture to the diameter of said member.

16. The improvement as recited in claims 10, 12 or 14, wherein said printing surface drive and guide means comprises a tractor-type paper-moving apparatus which is laterally movable and positionable at different locations to accommodate different paper widths, and said actuator means is attached to said tractor-type paper-moving apparatus to be moved and positioned therewith.

* * * * *